US012305337B2

(12) United States Patent
Breining

(10) Patent No.: US 12,305,337 B2
(45) Date of Patent: May 20, 2025

(54) COMPOSTABLE PAPERBOARD FOR PRESSWARE PRODUCTS

(71) Applicant: GPCP IP Holdings LLC, Atlanta, GA (US)

(72) Inventor: Michael A. Breining, Neenah, WI (US)

(73) Assignee: GPCP IP HOLDINGS LLC

( * ) Notice: Subject to any disclaimer, the term of this patent is extended or adjusted under 35 U.S.C. 154(b) by 0 days.

(21) Appl. No.: 17/568,049

(22) Filed: Jan. 4, 2022

(65) Prior Publication Data

US 2022/0282429 A1 Sep. 8, 2022

Related U.S. Application Data

(60) Provisional application No. 63/157,973, filed on Mar. 8, 2021.

(51) Int. Cl.

| | |
|---|---|
| ***C08B 15/02*** | (2006.01) |
| ***D21J 1/04*** | (2006.01) |
| ***D21J 1/08*** | (2006.01) |
| ***D21J 3/12*** | (2006.01) |

(52) U.S. Cl.
CPC . *D21J 1/08* (2013.01); *D21J 1/04* (2013.01); *D21J 3/12* (2013.01)

(58) Field of Classification Search
CPC ..... D21J 1/08; D21J 1/04; D21J 3/12
See application file for complete search history.

(56) References Cited

U.S. PATENT DOCUMENTS

| | | | | |
|---|---|---|---|---|
| 1,065,527 | A * | 6/1913 | Bhardwaj | F28G 3/166 15/317 |
| 8,430,660 | B2 | 4/2013 | Johns | |
| 8,584,929 | B2 | 11/2013 | Littlejohn | |
| 10,655,277 | B2 * | 5/2020 | Bhardwaj | D21H 19/42 |
| 2006/0051603 | A1 * | 3/2006 | Cleveland | B32B 27/08 427/372.2 |
| 2011/0262745 | A1 * | 10/2011 | Ronka | D21H 23/22 427/209 |
| 2014/0300026 | A1 * | 10/2014 | Taccolini | D21H 19/822 264/129 |
| 2018/0171559 | A1 * | 6/2018 | Hipps, Sr. | D21H 19/34 |
| 2019/0291134 | A1 * | 9/2019 | Mongrain | B32B 3/28 |
| 2020/0114625 | A1 * | 4/2020 | Van Trump | A47G 19/00 |

OTHER PUBLICATIONS

Standard Specification for Labeling of End Items that Incorporate Plastics and Polymers as Coatings or Additives with Paper and Other Substrates Designed to be Aerobically Composted in Municipal or Industrial Facilities, Feb. 10, 2021, ASTM (Year: 2021).*
Hai-Mu Ye, Preparation of Poly(butylene succinate) Crystals with Exceptionally High Melting Point and Crystallinity from Its Inclusion Complex Jun. 30, 2017, ACS (2017), p. 5425 (Year: 2017).*
Pachence https://www.sciencedirect.com/science/article/pii/B9780123706157500275 (Year: 2007).*

* cited by examiner

*Primary Examiner* — Jacob T Minskey
*Assistant Examiner* — Stephen M Russell

(57) ABSTRACT

Pressware products made from paperboard and methods for making same. The product can include a paperboard substrate and a compostable barrier coating, as determined by ASTM D6868-19, that is at least partially disposed on the paperboard substrate. The product can also include a paperboard substrate and a first compostable coating at least partially disposed on the paperboard substrate. The first compostable coating can include clay particles and less than 50 wt % binder, based on the total weight of the first compostable coating, wherein the binder is compostable, as determined by ASTM D6868-19. A second compostable barrier coating, as determined by ASTM D6868-19, can be at least partially disposed on the first compostable coating. The resulting pressware product is compostable, as determined by ASTM D6868-19.

19 Claims, No Drawings

COMPOSTABLE PAPERBOARD FOR PRESSWARE PRODUCTS

CROSS-REFERENCE TO RELATED APPLICATIONS

This application is based on U.S. Provisional Patent Application No. 63/157,973, filed on Mar. 8, 2021, which is hereby incorporated by reference in its entirety.

BACKGROUND

Description of the Related Art

Paperboard is used to make a wide variety of paper products, such as plates, bowls, and cups, and used to package a wide variety of materials. Paperboard is widely used to make such products and packaging because it is cheap to make and recyclable. Many consumers make purchasing decisions based upon whether a product is made from recycled materials or provided in a package made from recycled materials. More recently, consumers prefer environmentally responsible materials, especially those that are compostable and/or biodegradable.

Paperboard by itself is considered compostable. Paperboard is often coated with one or more material layers, however, to improve water and/or grease resistance as well as to improve strength and rigidity. Paperboard may also be coated to increase printability. These additional coatings can change the composability of the paperboard and can affect how the paper products are perceived by environmentally conscious consumers.

There is a need, therefore, for improved coated paperboard and products made therefrom that exhibit strength, rigidity and grease/moisture resistance all the while being compostable and/or biodegradable.

SUMMARY

Pressware products made from paperboard and methods for making same are provided. The product can include a paperboard substrate and a compostable barrier coating, as determined by ASTM D6868-19, that is at least partially disposed on the paperboard substrate.

In other embodiments, the product can include a paperboard substrate and a first compostable coating at least partially disposed on the paperboard substrate. The first compostable coating can include clay particles and less than 50 wt % binder, based on the total weight of the first compostable coating, wherein the binder is compostable, as determined by ASTM D6868-19. A second compostable barrier coating, as determined by ASTM D6868-19, can be at least partially disposed on the first compostable coating. The resulting pressware product is compostable, as determined by ASTM D6868-19.

DETAILED DESCRIPTION

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Furthermore, the exemplary embodiments provided herein can be combined in any combination of ways, i.e., any element from one exemplary embodiment can be used in any other exemplary embodiment, without departing from the scope of the disclosure.

Certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function.

In the following discussion and in the claims, the terms "including" and "comprising" are used in an open-ended fashion, and thus should be interpreted to mean "including, but not limited to." The phrase "consisting essentially of" means that the described/claimed layer or coating does not include any other components that will materially alter its properties by any more than 5% of that property, and in any case does not include any other component to a level greater than 3 mass %. The term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. For example, embodiments using "an additive" include embodiments where one, two, or more additives are used, unless specified to the contrary or the context clearly indicates that only one additive is used.

All numerical values in this disclosure can be exact or approximate values unless otherwise specifically stated. Accordingly, various embodiments of the disclosure can deviate from the numbers, values, and ranges disclosed herein without departing from the intended scope.

A detailed description will now be provided. Each of the appended claims defines a separate invention, which for infringement purposes is recognized as including equivalents to the various elements or limitations specified in the claims. Depending on the context, all references to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

The terms "paper" and "paperboard" are used interchangeably herein and refer to a sheet of material derived from wood pulp or other cellulose-based materials, both virgin and recycled. For simplicity and ease of description, however, embodiments of the present invention will be further described with reference to paperboard. The paperboard provided herein is compostable and can contain various amounts of recycled materials and can have various surface coatings, various colors, and all combinations thereof. For example, the paperboard can be or can include coated Solid Bleached Sulfate (SBS) paperboard. The paperboard can also be or can also include coated unbleached Kraft Paperboard (CUK), clay natural Kraft (CNK®), and/or solid unbleached sulfate (SUS®) paperboard (two variations of CUK). The paperboard can also be or can also include uncoated recycled paperboard (URB). The paperboard can also be or can also include material from old corrugated containers (OCC). The paperboard can also be or can also include coated recycled paperboard (CRB). The paperboard can also be or can also include groundwood.

By "compostable" it is meant that the paperboard, the coated paperboard and/or each coating is biodegradable into the soil, as determined by ASTM D6868-19. In certain embodiment, the term "compostable" refers to end items or individual coatings that satisfy at least 80%, or at least 85%, or at least 90%, or at least 95% of the requirements of ASTM D6868-19. By "biodegradable" it is meant that the paperboard, the coated paperboard and/or each coating is capable of being broken down by the action of living things (e.g. bacteria and/or microorganisms), as determined by ASTM D6868-19. In certain embodiment, the term "biodegradable" refers to end items or individual coatings that satisfy at least 80%, or at least 85%, or at least 90%, or at least 95% of the requirements of ASTM D6868-19.

The paperboard can be or can include recycled fiber. The amount of the recycled fiber can be least 70 wt % based on the total weight of the fiber in the paperboard. The amount of the recycled fiber can be at least 80 wt %, 85 wt %, 88 wt/o, 90 wt %, 93 wt %, 95 wt %, 97 wt %, or 99 wt %. The paperboard can be made entirely (i.e. 100 wt %) of recycled fibers, meaning there are no virgin fibers. Where the paperboard is not made entirely of recycled fibers, the balance can include varying amounts of virgin fibers, additives, fillers, or the like. Some of which are described in more detail below.

The recycled fiber can be substantially derived from old corrugated containers ("OCC"). In certain embodiments, the recycled fiber can be at least 25 wt % of fibers recycled or otherwise recovered from OCC. The recycled fiber can be at least 35 wt %, at least 45 wt %, at least 50 wt %, at least 60 wt %, at least 70 wt %, at least 80 wt %, at least 90 wt %, at least 96 wt %, or at least 99 wt % of fibers recycled or otherwise recovered from OCC. The recycled fiber also can be 100 wt % of fibers recycled or otherwise recovered from OCC.

The recycled fiber can be substantially derived from pre-consumer products. In certain embodiments, the recycled fiber can be at least 25 wt % of pre-consumer fiber. For example, the recycled fiber can be at least 35 wt %, at least 45 wt %, at least 50 wt %, at least 60 wt %, at least 70 wt %, at least 80 wt %, at least 90 wt %, at least 96 wt %, or at least 99 wt % of pre-consumer fiber. Pre-consumer fiber refers to fiber obtained from any paper or paperboard scrap generated, for example, during a packaging manufacturing process. Pre-consumer fiber can include fiber obtained from packaging materials that have been manufactured but are not suitable for use in packaging materials for quality or other reasons. Pre-consumer fiber also can include fiber obtained from the recycling of a waste stream in a forming process.

The recycled fiber can be substantially derived from post-consumer products. In certain embodiments, the recycled fiber can be at least 25 wt % of post-consumer fiber. For example, the recycled fiber can be at least 35 wt %, at least 45 wt %, at least 50 wt %, at least 60 wt %, at least 70 wt %, at least 75 wt %, at least 80 wt %, at least 85 wt %, at least 90 wt %, or 100% of post-consumer fiber. Post-consumer fibers refer to fibers obtained from paper or paperboard products that have been discarded for disposal or recovery after having completed their intended uses. Post-consumer fiber can be obtained from the sorting of materials from a consumer or manufacturer waste stream.

The paperboard can include less than 30 wt % of virgin fiber based on the total weight of the fiber in the paperboard. More preferably, the paperboard includes less than 20 wt %, less than 15 wt %, less than 10 wt %, less than 8 wt %, less than 5 wt %, or less than 2 wt/o of virgin fiber. In any embodiment above or elsewhere herein, the paperboard can have no virgin fiber and can be made entirely of recycled fiber. Virgin fibers refer to fibers that have never before been used to prepare paper or paperboard and are derived directly from trees or plant-based sources.

Coatings

The paperboard can be at least partially lined or coated on one or both sides with non-paperboard or non-paper materials. For example, the paperboard can be at least partially coated with one or more polymers, one or more clays, one or more waxes, one or more other suitable oil resistant materials and/or waterproof materials, one or more oxygen barrier materials, or one or more minerals, e.g. clay, silica, calcium carbonate, talc, titanium dioxide or the like. The paperboard provides a base layer or substrate that one more coatings are to be disposed thereon.

Any suitable number of coatings and/or suitable types of coatings can be used. According to one or more embodiments, the paperboard can be coated with clay and one or more additional coatings wherein the clay and additional coatings are water-based emulsions formulated so that the coatings provide high temperature resistance, resistance to tack/melt of at least 250° F. or more. Having a resistance to tack/melt of at least 250° F. or more allows the paperboard to have both resistance to sticking during forming and resistance to hot food and microwave reheating.

Each coating can be applied as a single layer, continuous or not, to one or both sides of the paperboard. Each coating can be applied or combined with one or more other coatings to form a multi-layer coating on one or both sides of the paperboard. Each coating can be applied directly on the paperboard or directly on one or more other coating layers or partial layers thereof. Such coating layer(s) can have a thickness ranging from a low of about 0.002 mm, about 0.005 mm, about 0.01 mm, about 0.03 mm, about 0.05 mm, about 0.07 mm, or about 0.1 mm to a high of about 0.15 mm, about 0.17 mm, about 0.2 mm, about 0.25 mm, about 0.3 mm, or about 0.35 mm.

Suitable coatings can include, but are not limited to, any one or more of the following: cellulose, starch (e.g. grain starch, root starch, vegetable starch), wax, clay, fatty acids, alginates, plant fiber, nitrocellulose, polyvinyl alcohol (PVOH), ethylene vinyl alcohol (EVOH), polylactic acid (PLA), polyamide-epichlorohydrin (PAE), polyester, poly (beta-amino) esters (PBAE), polycaprolactone (PCL), polybutylene succinate (PBS), polybutylene adipate (PBA), polyhydroxyalkanoate (PHA), polyvinyl butyral (PBV), polybutyrate adipate terephthalate (PBAT), or derivatives thereof.

Suitable coatings can also include one or more sizing agents, waxes, natural rosins and/or clays. Suitable sizing agents can be or can include alkenyl ketene dimer (ALKD), alkyl ketene dimer (AKD), and alkenyl succinic anhydride (ASA), fluorochemicals, silicones, hydrophobically modified anionic polymer (HMAP), hydrophobically modified cationic polymer (HMCP), ethylene-acrylic acid (EAA), neutral rosin emulsions, and combinations thereof. In certain embodiments, a coated paperboard specifically excludes fluorochemicals. Suitable coatings can also include one or more organic or inorganic fillers, such as calcium carbonate, magnesium carbonate, silica, calcium oxide, alumina, titanium dioxide, or any mixture thereof.

A suitable coating can include a plurality of inorganic particles (e.g. calcium carbonate or clay) and a binder to hold the particles together. The binder is preferably compostable. The binder is preferably made from the one or more compostable materials described herein. The binder can be less than 50 wt %, less than 40 wt %, less than 30 wt %, less than 20 wt %, less than 10 wt %, or less than 5 wt % of the coating layer, based on the total weight of the coating. For example, the coating can include one or more compostable binders in an amount ranging from a low of about 1 wt %, 3 wt %, or 5 wt % to a high of 35 wt %, 40 wt %, or 49 wt %.

In certain embodiments, each coating can include one or more non-compostable materials so long as the individual coating is considered to be compostable per ASTM D6868-19. For example, a layer of coating can include less than 99.9 wt %, less than 90 wt %, less than 85 wt %, less than 65 wt %, less than 40 wt %, or less than 5 wt % of one or more non-compostable materials, the balance being one or more compostable materials, so long as the overall coating layer is compostable per ASTM 6464. Non-compostable materials can include one or more inorganic materials, such as clay, silica, calcium carbonate, talc, titanium dioxide, and the like.

Non-compostable materials can also include polymers such as butylene polymer, ethylene polymer, high density polyethylene (HDPE) polymer, medium density polyethylene (MDPE) polymer, low density polyethylene (LDPE) polymer, propylene (PP) polymer, isotactic polypropylene (iPP) polymer, high crystallinity polypropylene (HCPP) polymer, ethylene-propylene (EP) copolymers, ethylene-propylene-butylene (EPB) terpolymers, propylene-butylene (PB) copolymer, ethylene elastomers, ethylene-based plastomers, propylene elastomers, styrene butadiene rubber (SBR), acrylic polymers such as styrene acrylates, ethylene vinyl acetate (EVA), ethylene acrylic acid (EAA), and ethylene methyl acrylate copolymers (EMA), polyvinylidene chloride (PVdC) and combinations or blends thereof.

In certain embodiments, each coating layer can be free or substantially free of a thermoplastic or polyolefin such as, for example, polyethylene, polypropylene, polyethylene terephthalate, nylon 6,6, polyvinylidene chloride, or any combinations thereof. Each coating layer can have less than 5.0 wt %, less than 4.0 wt %, less than 3.0 wt %, less than 2.0 wt %, or less than 1.0 wt % of a thermoplastic or polyolefin.

In certain embodiments, one or more thermoplastic (extrusion grade) polymers can be used as a coating layer. In certain embodiments, one or more thermoplastic (extrusion grade) polymers can be used as a coating layer when one or more additional non-thermoplastic coatings cover the thermoplastic coating layer to prevent direct contact of the thermoplastic with the pressware tools. It is preferred that if such thermoplastic (extrusion grade) coatings are used, one or more additional non-thermoplastic coatings cover the thermoplastic coatings to prevent direct contact of the thermoplastic coatings with the pressware tools. As mentioned above, coatings made from water-based emulsions that provide high temperature resistance, resistance to tack/melt of at least 250° F. or more are preferred as outer layers. Having a resistance to tack/melt of at least 250° F. or more allows the coated paperboard to have both resistance to sticking during forming and resistance to hot food and microwave reheating. A resistance to tack/melt of at least 265° F. or more, 280° F. or more, 300° F. or more, or 315° F. or more are preferred.

The compostable materials can be used individually, or in any combination, such as a blend or mixture of two or more compostable materials. Each coating layer can contain at least 85 wt %, at least 90 wt %, at least 93 wt %, at least 96 wt %, at least 98 wt %, at least 99 wt %, or about 100 wt % of one or more compostable materials so long as the coating layer is compostable in accordance with ASTM 6464.

In certain embodiments, the one or more coatings are waterproof. By "waterproof", it is meant that the individual layer or coating has a Cobb Value of 0 (zero) grams/$m^2$ as measured by the TAPPI test method T 441 (120 seconds), meaning 100% water and grease absorption protection (i.e. impermeable).

In certain embodiments, the one or more coatings are water resistant or moisture resistant. The terms "water resistant" and "moisture resistant" are used interchangeably herein and both refer to a coating or material having a Cobb Value greater than 0 (zero) g/$m^2$ as measured by the TAPPI test method T 441 (120 seconds), meaning less than 100% water and grease absorption protection. As such, the terms "water resistant" and "moisture resistant" refer to coatings or materials that can absorb water or moisture or other liquids.

Any suitable method for applying each coating can be used. For example, each coating can be applied by an emulsion coating technique. The coatings can also be applied by extrusion, co-extrusion, lamination, press, roll coating, curtain coating and/or a blade coating process.

Each coating can be clear, white, or pigmented to have any desirable color. The thickness of each coating layer can vary. For example, each coating layer can have a thickness ranging from about 5 to 100 microns, or about 5 to 50 microns, or about 5 to 25 microns. The resulting coated paperboard can have any suitable thickness. For example, the resulting coated paperboard can have a thickness of about 12 mil to about 22 mil; about 15 mil to about 20 mil; or about 16 mil to about 20 mil. The board thickness can also range from a low of about 14, 15, or 16 to a high of about 17, 18, 19, or 20 mils.

The dry basis weight of each coating layer can range from about 0.4 lbs/ream to about 40 lbs/ream. For example, the dry basis weight of each coating layer can range from a low of about 0.4, about 1.0, or about 2.5 lbs/ream to a high of about 10, about 30, or about 35 lbs/ream. The dry basis weight of each coating layer can also be about 0.5 lbs/ream to about 30 lbs/ream, or about 3 lbs/ream to about 25 lbs/ream, or about 5 lbs/ream to about 20 lbs/ream. The dry basis weight of each coating layer can also be about 0.4 lbs/ream, or about 2.5 lbs/ream, or about 6 lbs/ream, or about 15 lbs/ream, or about 18 lbs/ream, or about 20 lbs/ream, or about 22 lbs/ream, or about 25 lbs/ream.

The formation of a first layer over or on a second layer, as provided herein, can include embodiments in which the first and second layers are formed in direct contact, and can also include embodiments in which additional layers can be formed by interposing the first and second layers, such that the first and second layer are not in direct contact.

Pulp Additives

Each of the pulp stocks used to form the paperboard can include one or more additives to improve the processing of the pulp stock and/or improve the mechanical and/or strength properties of the paperboard made therefrom. Any such additives can also be added to each individual coating layer. Preferred additives are water soluble. Generally, materials that can be used to improve the processing of the pulp stocks include, but are not limited to, slimicides (used to control microbial growth), pH controls, retention aids (used to improve retention of fines and fillers) and drainage aids (used to improve water removal at the wet end). Materials that can be used to improve appearance and/or durability of the paperboard can include, but are not limited to, fillers (e.g.

clay or talc to help improve optical and surface properties), starch (to augment dry strength properties of finished paperboard), wet strength resins (to improve tear properties of paperboard in damp and humid conditions), sizing agents (such as rosins to control penetration of liquids into finished paperboard) and one or more polymers (to provide a grease barrier in finished paperboard). Suitable additives to the pulp stock and/or the paperboard can include one or more opacifying agents, pigments or colorants, and can include iron oxide, carbon black, aluminum, titanium dioxide (TiO2), calcium carbonate (CaCO3), polybutylene terephthalate (PBT), talc, beta nucleating agents, and combinations thereof.

Other suitable additives can include, but are not limited to opacifying agents, pigments, colorants, fillers, softeners, preservatives, anti-fungal agents, spacers, crosslinks, surfactants, defoamers, rheology modifiers, slip agents, antioxidants, anti-static agents, moisture barrier additives, gas barrier additives and combinations thereof. Examples of suitable opacifying agents, pigments or colorants are iron oxide, carbon black, aluminum, titanium dioxide ($TiO_2$), calcium carbonate ($CaCO_3$), polybutylene terephthalate (PBT), talc, beta nucleating agents, and combinations thereof.

Suitable slip agents can include higher aliphatic acid amides, higher aliphatic acid esters, waxes, silicone oils, and metal soaps. Such slip agents can be used in amounts ranging from about 0.1 wt % to about 2 wt % based on the total weight of the layer to which it can be added.

Suitable antioxidants can include phenolic antioxidants. Antioxidants can be generally used in amounts ranging from about 0.1 wt % to 2 wt %, based on the total weight of the layer(s) to which it can be added.

Suitable anti-static agents can include alkali metal sulfonates, polyether-modified polydiorganosiloxanes, polyalkylphenylsiloxanes, and tertiary amines. Such anti-static agents can be used in amounts ranging from about 0.05 wt % to about 3 wt %, based upon the total weight of the layer(s).

Suitable fillers can include finely divided inorganic solid materials such as silica, fumed silica, diatomaceous earth, calcium carbonate, calcium silicate, aluminum silicate, kaolin, talc, bentonite, clay, and pulp.

Suitable moisture and gas barrier additives can include effective amounts of low-molecular weight resins, hydrocarbon resins, particularly petroleum resins, styrene resins, cyclopentadiene resins, and terpene resins.

End Uses

The paperboard can be used in any number of press formed consumer products. For example, the paperboard can be used to make pressware products in the form of a plate, tray, bowl, cutting board, platter, container, or other product formed with hot metal dies. Processes for making such press formed products are described in U.S. Pat. Nos. 8,584,929 B2 and 8,430,660 B2, including the forming temps, pressure, dwell times, and speed disclosed therein.

Strength Properties

The pre-coated paperboard (i.e. the paperboard base layer or substrate) can have any suitable thickness or caliper. For example, the pre-coated paperboard can have a board caliper of about 12 mil to about 22 mil. The pre-coated paperboard also can have a board caliper of about 13 mil to about 20 mil, or about 16 mil to about 20 mil. The board caliper can also range from a low of about 12, 14, 15, or 16 to a high of about 17, 18, 19, 20, or 22 mils.

The paperboard base layer or substrate can have a basis weight of about 163 grams to about 550 grams per square meter (about 100 pounds to about 339 pounds per 3,000 square feet) or about 195 grams to about 500 grams per square meter (about 120 pounds to about 306 pounds per 3,000 $ft^2$). The basis weight of the paperboard base layer or substrate can be a low of about 195 grams, about 210 grams, about 225 grams, about 250 grams, or about 275 grams to a high of about 325 grams, about 350 grams, about 375 grams, about 400 grams, about 425 grams, or about 450 grams per square meter.

The coated or uncoated paperboard can have a board density or apparent density of less than about 15 lbs per 3,000 square feet per mil (lbs/3,000 $ft^2$/mil). For example, the apparent density of the coated or uncoated paperboard can be less than about 13 lbs/3,000 $ft^2$/mil; less than about 12 lbs/3,000 $ft^2$/mil; less than about 11.5 lbs/3,000 $ft^2$/mil; less than about 11 lbs/3,000 $ft^2$/mil; or less than about 10 lbs/3,000 $ft^2$/mil. The apparent density of the coated or uncoated paperboard can also range from a low of about 8.0, 8.5 or 9.0 to a high of about 11, 13, or 15 lbs/3,000 $ft^2$/mil.

The coated or uncoated paperboard can have a cross direction ("CD") Taber Stiffness of about 40 g*cm or more. For example, the CD Taber Stiffness can be about 45 g*cm or more, about 50 g*cm or more, about 55 g*cm or more, about 65 g*cm or more, about 70 g*cm or more, or about 75 g*cm or more. The CD Taber Stiffness also can range from a low of about 50, 55, or 60 to a high of about 75, 100, or 125 g*cm The coated or uncoated paperboard can have a machine direction ("MD") Taber Stiffness of about 150 g*cm or more. For example, the MD Taber Stiffness can be about 100 g*cm or more, about 120 g*cm or more, about 130 g*cm or more, about 140 g*cm or more, about 150 g*cm or more, or about 170 g*cm or more. The MD Taber Stiffness also can range from a low of about 100, 125, or 150 to a high of about 175, 200, 225 g*cm.

The coated or uncoated paperboard can have a MD/CD Taber Stiffness ratio of 1.0 to 3.0. The MD/CD Taber Stiffness ratio can also be 1.5 to 2.8. The MD/CD Taber Stiffness ratio can also be 1.5 to 2.5, or 1.6 to 2.5, 1.5 to 2.2, or 1.5 to 2.0.

The coated or uncoated paperboard can have a moisture content of less than 10%. The moisture content is preferably less than 9%, less than 8%, less than 7%, less than 6%, less than 5%, or less than 4%. The moisture content can range from a low of about 3%, 4%, 5% to a high of about 5.5%, 6.5%, or 7.5%.

According to one or more embodiments, the coated and uncoated paperboard is compostable and is constructed of at least one layer of compostable materials, preferably 2 or more layers and more preferably 3 or more layers. For example, a layered paperboard can include at least a base sheet or substrate and at least a first coating layer disposed at least partially over at least one side of the substrate. The paperboard can be unprinted or can be printed on one or both sides.

One or both sides of the paperboard substrate or the coated paperboard can be surface treated to increase the surface energy to render the base sheet surface more receptive to metallization, coatings, printing inks, and/or lamination. The surface treatment can be carried out according to one of the methods known in the art including corona discharge, flame, plasma, chemical treatment, or treatment by means of a polarized flame.

As mentioned, a coating layer might only partially cover an underlying coating layer or the paperboard. By "partially cover" it is meant that a coating layer may only cover about 5% to about 30% of the underlying surface. The coverage can also range from a low of about 5%, 8%, or 12% to a high of about 15%, 17%, or 20%. In certain embodiments, the coverage will be about 10%, about 12%, about 15%, about 16%, about 17%, or about 19% of the surface area of the underlying contact surface.

If more than one coating is present, an adhesive or adhesive layer can be used. Such adhesive or adhesive layer can include one or more tackifiers. The tackifiers are preferable bio-based and/or biodegradable. The amount of the tackifier, if present, can range from a low of about 1 wt %, about 3 wt %, or about 5 wt % to a high of about 10 wt %, about 12 wt %, or about 15 wt %, based on the total weight of the adhesive or adhesive layer. A suitable tackifier can provide a peel strength between the plies of less than about 340 g/2.54 cm, less than about 280 g/2.54 cm, or less than about 220 g/2.54 cm at a temperature of about 23° C. The peel strength can range from a low of about 100 g/2.54 cm, about 150 g/2.54 cm, about 200 g/2.54 cm, about 215 g/2.54 cm, or about 235 g/2.54 cm to a high of about 255 g/2.54 cm, about 270 g/2.54 cm, or about 285 g/2.54 cm at a temperature of about 23° C.

Any one or more of the coating layers or paperboard substrates described above or elsewhere herein can include one or more colorants to provide color and graphics to the individual layer(s) or substrate(s). Any suitable colorant can be used, including any one or more pigments, inks, paints, dyes, and combinations thereof. Suitable colorants that affect or modify opacity and brightness can also be used. If any one or more additives are present in an individual layer or substrate, each layer or substrate could include less than 5.0 wt %, less than 4.0 wt %, less than 3.0 wt %, less than 2.0 wt %, or less than 1.0 wt % of such additive(s).

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art. The term "about" includes the inherent and expected tolerances and/or slight variations that would be considered by a person of ordinary skill in the art to be within the bounds of the indicated value.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A pressware product made from paperboard, comprising:

a paperboard substrate; and.

a compostable barrier coating, as determined by ASTM D6868-19, that is at least partially disposed on the paperboard substrate, the compostable barrier coating comprising:

at least 50 wt % one or more non-compostable materials selected from the group consisting of clay, silica, calcium carbonate, talc, titanium dioxide, and thermoplastic polymers, and less than 50 wt % binder, based on the total weight of the compostable barrier coating, wherein the binder is a biodegradable polyester, and wherein the pressware product is compostable, as determined by ASTM D6868-19.

2. The pressware product of claim 1, wherein the biodegradable polyester is selected from the group consisting of polyhydroxyalkanoate, polybutylene succinate, polycaprolactone, and polybutylene adipate terephthalate.

3. The pressware product of claim 1, wherein the biodegradable polyester is polyhydroxyalkanoate.

4. The pressware product of claim 1, wherein the compostable barrier coating has a melt temperature greater than 250° F.

5. The pressware product of claim 1, wherein the product is a plate, tray, platter, bowl or cutting board.

6. The pressware product of claim 1, wherein the paperboard substrate has a thickness of 12 to 22 mils.

7. A pressware product made from paperboard, comprising:

a paperboard substrate;

a first compostable barrier coating at least partially disposed on the paperboard substrate, the first compostable barrier coating comprising at least 50 wt % clay particles, and less than 50 wt % binder, based on the total weight of the first compostable barrier coating, wherein the binder is compostable, as determined by ASTM D6868-19; and a second compostable barrier coating, as determined by ASTM D6868-19 that is at least partially disposed on the first compostable coating, wherein the pressware product is compostable, as determined by ASTM D6868-19.

8. The pressware product of claim 7, wherein the binder is a biodegradable polyester.

9. The pressware product of claim 7, wherein the binder is selected from the group consisting of polyhydroxyalkanoate, polybutylene succinate, polycaprolactone, and polybutylene adipate terephthalate.

10. The pressware product of claim 7, wherein each of the compostable barrier coatings comprises one or more biodegradable polyesters.

11. The pressware product of claim 7, wherein the second compostable barrier coating is selected from the group consisting of polyhydroxyalkanoate, polybutylene succinate, polycaprolactone, and polybutylene adipate terephthalate.

12. The pressware product of claim 7, wherein the binder and the second compostable barrier coating are the same material.

13. The pressware product of claim 7, wherein the binder and the second compostable harrier coating are not the same material.

14. The pressware product of claim 7, wherein each of the compostable barrier coatings have a melt temperature greater than 250° F.

15. The pressware product of claim 7, wherein the product is a plate, tray, platter, bowl or cutting board.

16. The pressware product of claim 7, wherein the product has an overall thickness of 12 to 22 mils and the paperboard substrate has a thickness of 12 to 22 mils.

17. The pressware product of claim 1, wherein the paperboard substrate comprises at least 70 wt % recycled fiber derived from pre-consumer products, based on the total weight of the fiber in the paperboard.

18. The pressware product of claim 1, wherein the paperboard substrate comprises at least 70 wt % recycled fiber derived from post-consumer products, based on the total weight of the fiber in the paperboard.

19. The pressware product of claim 1, wherein the paperboard substrate is less than 30 wt % virgin fiber, based on the total weight of the fiber in the paperboard.

* * * * *